US006252937B1

(12) United States Patent
Snyder

(10) Patent No.: US 6,252,937 B1
(45) Date of Patent: Jun. 26, 2001

(54) HIGH THERMAL PERFORMANCE CATHODE VIA HEAT PIPES

(75) Inventor: Douglas J. Snyder, Brookfield, WI (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/395,529

(22) Filed: Sep. 14, 1999

(51) Int. Cl.[7] ..... H01J 35/10

(52) U.S. Cl. ..... 378/141; 378/130; 378/121; 378/136; 313/30

(58) Field of Search ..... 378/141, 130, 378/136, 127, 121; 313/11, 30

(56) References Cited

U.S. PATENT DOCUMENTS 3,735,175 * 5/1973 Blomgren, Jr. .
4,405,876 * 9/1983 Iversen ..... 313/30
4,455,504 * 6/1984 Iversen ..... 313/30
4,674,109 * 6/1987 Ono ..... 378/130
6,075,839 * 6/2000 Treseder ..... 378/140

FOREIGN PATENT DOCUMENTS

1058005 * 11/1983 (SU) ..... H01J/35/02

* cited by examiner

*Primary Examiner*—David V. Bruce
*Assistant Examiner*—Pamela R. Hobden
(74) *Attorney, Agent, or Firm*—Foley & Lardner; Christian G. Cabou

(57) ABSTRACT

An x-ray tube for emitting x-rays which includes an anode and a cathode is disclosed herein. The x-ray tube includes a housing, an anode disposed in the housing and including a target, a cathode disposed in the housing at a distance from the anode, and a heat pipe thermally coupled to the cathode and extending away from the electron emitter. The cathode includes an electron emitter which is configured to emit electrons which hit the target of the anode and produce x-rays. The heat pipe provides transfer of thermal energy away from the electron emitter and into a heat sink.

20 Claims, 4 Drawing Sheets

HIGH THERMAL PERFORMANCE CATHODE VIA HEAT PIPES

BACKGROUND OF THE INVENTION

The present invention relates generally to imaging systems. More particularly, the present invention relates to x-ray tube cathodes with enhanced thermal performance.

Electron beam generating devices, such as x-ray tubes and electron beam welders, operate in a high temperature environment. In an x-ray tube, for example, the primary electron beam generated by the cathode deposits a very large heat load in the anode target to the extent that the target glows red-hot in operation. Typically, less than 1% of the primary electron beam energy is converted into x-rays, while the balance is converted to thermal energy. This thermal energy from the hot target is radiated to other components within the vacuum vessel of the x-ray tube, and is removed from the vacuum vessel by a cooling fluid circulating over the exterior surface of the vacuum vessel. Additionally, some of the electrons back scatter from the target and impinge on other components within the vacuum vessel, causing additional heating of the x-ray tube. As a result of the high temperatures caused by this thermal energy, the x-ray tube components are subject to high thermal stresses which are problematic in the operation and reliability of the x-ray tube.

Typically, an x-ray beam generating device, referred to as an x-ray tube, comprises opposed electrodes enclosed within a cylindrical vacuum vessel. The vacuum vessel is typically fabricated from glass or metal, such as stainless steel, copper or a copper alloy. As mentioned above, the electrodes comprise the cathode assembly that is positioned at some distance from the target track of the rotating, disc-shaped anode assembly. Alternatively, such as in industrial applications, the anode may be stationary.

The target track, or impact zone, of the anode is generally fabricated from a refractory metal with a high atomic number, such as tungsten or tungsten alloy. A typical voltage difference of 60 kV to 140 kV is maintained between the cathode and anode assemblies to accelerate the electrons. The hot cathode filament emits thermal electrons that are accelerated across the potential difference, impacting the target zone of the anode at high velocity. A small fraction of the kinetic energy of the electrons is converted to high energy electromagnetic radiation, or x-rays, while the balance is contained in back scattered electrons or converted to heat. The x-rays are emitted in all directions, emanating from the focal spot, and may be directed out of the vacuum vessel.

In an x-ray tube having a metal vacuum vessel, for example, an x-ray transmissive window is fabricated into the metal vacuum vessel to allow the x-ray beam to exit at a desired location. After exiting the vacuum vessel, the x-rays are directed to penetrate an object, such as human anatomical parts for medical examination and diagnostic procedures. The x-rays transmitted through the object are intercepted by a detector and an image is formed of the internal anatomy. Further, industrial x-ray tubes may be used, for example, to inspect metal parts for cracks or to inspect the contents of luggage at airports.

Since the production of x-rays in a medical diagnostic x-ray tube is by its nature a very inefficient process, the components in x-ray generating devices operate at elevated temperatures. To cool the x-ray tube, the thermal energy generated during tube operation must be transferred from the anode through the vacuum vessel and be removed by a cooling fluid. The vacuum vessel is typically enclosed in a casing filled with circulating, cooling fluid, such as dielectric oil. The casing supports and protects the x-ray tube and provides for attachment to a computed tomography (CT) system gantry or other x-ray system or structure. Also, the casing is lined with lead to provide stray radiation shielding.

The cooling fluid often performs two duties: cooling the vacuum vessel, and providing high voltage insulation between the anode and cathode connections in the bipolar configuration. The performance of the cooling fluid may be degraded, however, by excessively high temperatures that cause the fluid to boil at the interface between the fluid and the vacuum vessel and/or the transmissive window. The boiling fluid may produce bubbles within the fluid that may allow high voltage arcing across the fluid, thus degrading the insulating ability of the fluid. Further, the bubbles may lead to image artifacts, resulting in low quality images. Thus, the current method of relying on the cooling fluid to transfer heat out of the x-ray tube may not be sufficient.

As X-ray tubes continue to grow in heat storage capability, the duration of an X-ray scan increases and the cooling time between scans decreases. The longer scans and shorter cool times require that the filaments in the cathode be held at high temperatures for a greater percentage of time. As a result, the cup that holds the filaments experiences higher temperatures than that of prior x-ray tubes.

In current high performance CT tubes, it has been observed that these higher temperatures can result in braze failures and distortions in the cathode arm. This results in image quality degradation. A conventional approach to the problem is to make a more conductive thermal path from the cathode cup to the cooler oil that lies in the X-ray tube. However, adding greater thermal conduction typically results in higher mass in the cathode support structure, while only marginally improving thermal performance. The higher mass often results in cathode vibration problems which compromise the x-ray tube's image quality.

Thus, there is a need for an apparatus which significantly increases the heat flow away from the cathode cup, resulting in cooler cathode assembly temperatures. Further, there is a need for a cathode design with greater ability to produce long duration scans without sacrificing image quality or long term reliability of the X-ray tube due to joint failure or mechanical component distortions. Even further, there is a need for a cathode design which greatly increases the heat flow from the cathode cup without producing a lower natural frequency in the cathode design due to added mass, resulting in good image quality while still giving good thermal performance of the cathode assembly.

BRIEF SUMMARY OF THE INVENTION

One embodiment of the invention relates to an x-ray tube for emitting x-rays which includes an anode and a cathode. The x-ray tube includes a housing, an anode disposed in the housing and including a target, a cathode disposed in the housing at a distance from the anode, and a heat pipe thermally coupled to the cathode and extending away from the electron emitter. The cathode includes an electron emitter which is configured to emit electrons which hit the target of the anode and produce x-rays. The heat pipe provides transfer of thermal energy away from the electron emitter.

Another embodiment of the invention relates to an x-ray tube for emitting x-rays with increased performance by effective heat dissipation. The x-ray tube includes an electron source, an x-ray source, and heat pipe means for selectively directing heat energy away from the electron source. The x-ray source provides x-rays from a bombardment of electrons from the electron source.

Another embodiment of the invention relates to a method for dissipating heat from a cathode in an x-ray tube during operation of the x-ray tube. The method includes providing electrons using an electron emitter in the cathode and transferring heat away from the electron emitter with at least one heat pipe. The electrons produce x-rays and heat upon impact with a target.

Other principle features and advantages of the present invention will become apparent to those skilled in the art upon review of the following drawings, the detailed description, and the appended claims.

BRIEF DESCRIPTION OF THE DRAWINGS

The invention will become more fully understood from the following detailed description, taken in conjunction with the accompanying drawings, wherein like reference numerals denote like elements, in which.

DETAILED DESCRIPTION OF THE INVENTION

Figure 1:
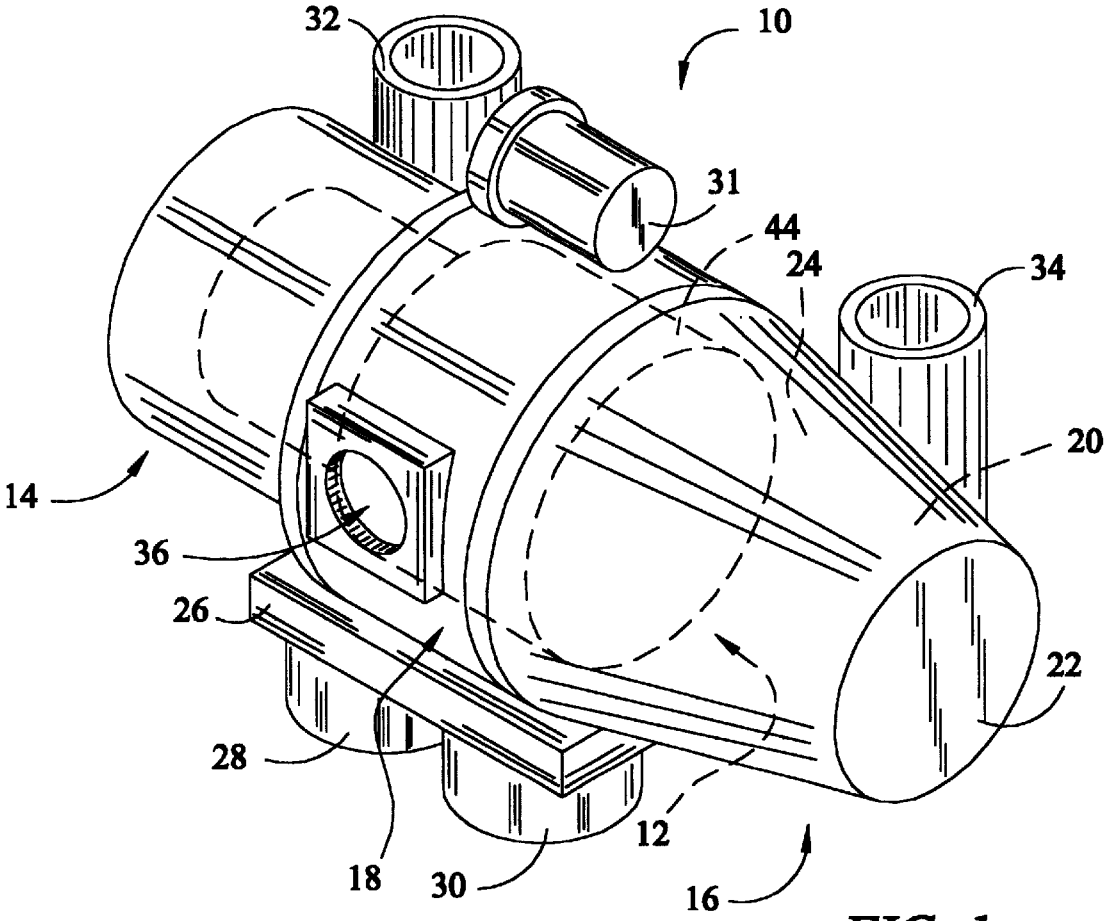
FIG. 1 is a perspective view of a housing having an x-ray tube in accordance with the present invention.

FIG. 1 illustrates a housing unit 10 for an x-ray generating device or x-ray tube 12. Housing unit 10 includes an anode end 14, cathode end 16, and a center section 18 positioned between anode end 14 and cathode end 16. X-ray generating device 12 is enclosed in a fluid chamber 20 within a casing 22.

Fluid chamber 20 generally is filled with a fluid 24, such as, dielectric oil, which circulates throughout housing 10 to cool x-ray generating device 12. Fluid 24 within fluid chamber 20 is cooled by a radiator 26 positioned to one side of center section 18. Fluid 24 moves throughout fluid chamber 20 and radiator 26 by a pump 31. Preferably, a pair of fans 28 and 30 are coupled to radiator 26 for providing cooling air flow over radiator 26 as hot fluid flows through it.

Electrical connections to x-ray generating device 12 are provided through an anode receptacle 32 and a cathode receptacle 34. X-rays emit from x-ray generating device 12 through an x-ray transmissive window 36 in casing 22 at one side of center section 18.

Figure 2:
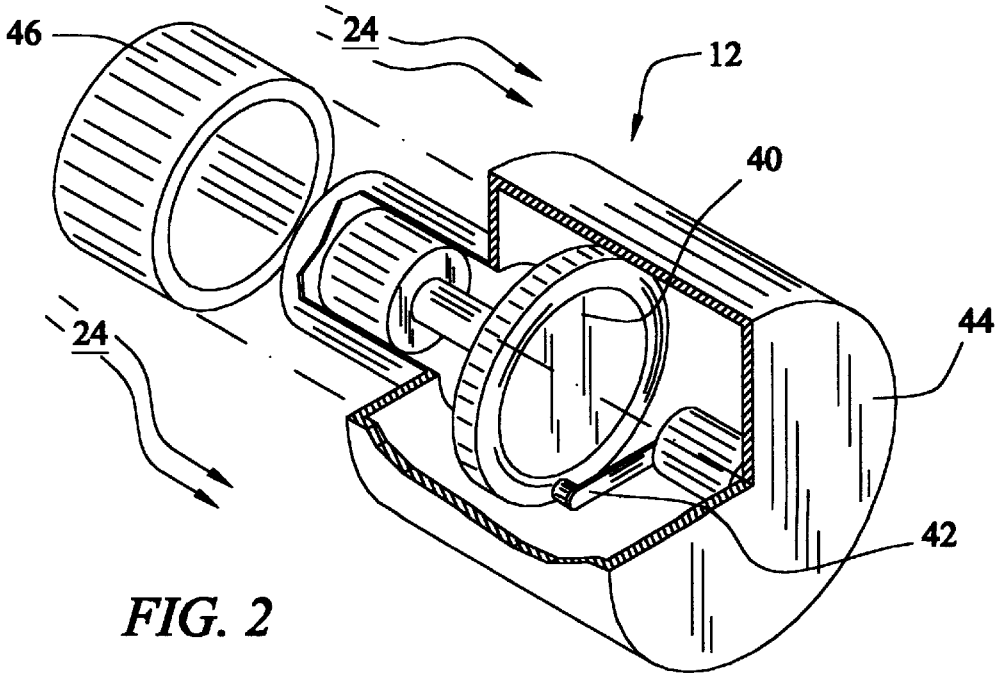
FIG. 2 is a sectional perspective view with the stator exploded to reveal a portion of a cathode assembly of the x-ray tube of FIG. 1.

As shown in FIG. 2, x-ray generating device 12 includes a target anode assembly 40 and a cathode assembly 42 disposed in a vacuum within a vessel 44. A stator 46 is positioned over vessel 44 adjacent to target anode assembly 40. Upon the energization of the electrical circuit connecting target anode assembly 40 and cathode assembly 42, which produces a potential difference of, e.g., 60 kV to 140 kV, electrons are directed from cathode assembly 42 to target anode assembly 40. The electrons strike target anode assembly 40 and produce high frequency electromagnetic waves, or x-rays, and residual energy. The residual energy is absorbed by the components within x-ray generating device 12 as heat. The x-rays are directed out through an x-ray transmissive window pane 48 and window 36, which help direct the x-rays toward the object being imaged (e.g., the patient). In one embodiment, target anode assembly 40 includes a rotating target which distributes the area impacted by the electrons from the cathode assembly 42.

Figure 3:
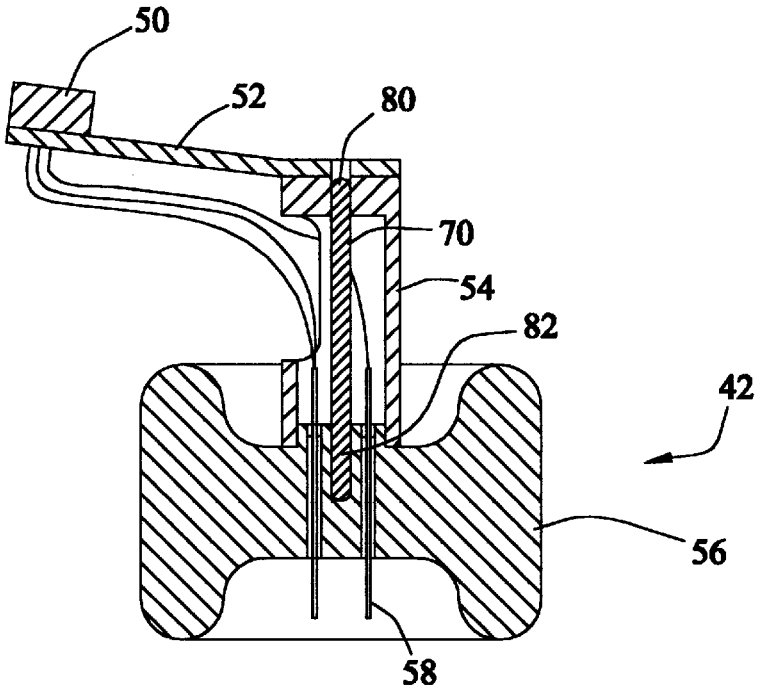
FIG. 3 is a cross sectional view of the cathode assembly of the x-ray tube of FIG. 1.

FIG. 3 illustrates a cross sectional view of cathode assembly 42. Cathode assembly 42 includes a cathode cup 50, an arm 52, a post 54, a cathode insulator 56, electrical connectors 58, and a heat pipe 70. Cathode cup 50 is made of a high temperature metal and contains filaments which heat up and provide electrons. The temperatures involved in the heating of the filaments are approximately 2600° C.

Arm 52 extends between cathode cup 50 and post 54. Post 54 extends between the end of arm 52 distal to cathode cup 50 and cathode insulator 56. Cathode insulator 56 is designed in a shape to provide electrical insulation of the high electrical potential cathode parts. Electrical connectors 58 electrically couple filaments in cathode cup 50 with x-ray generating device 12.

Figure 5:
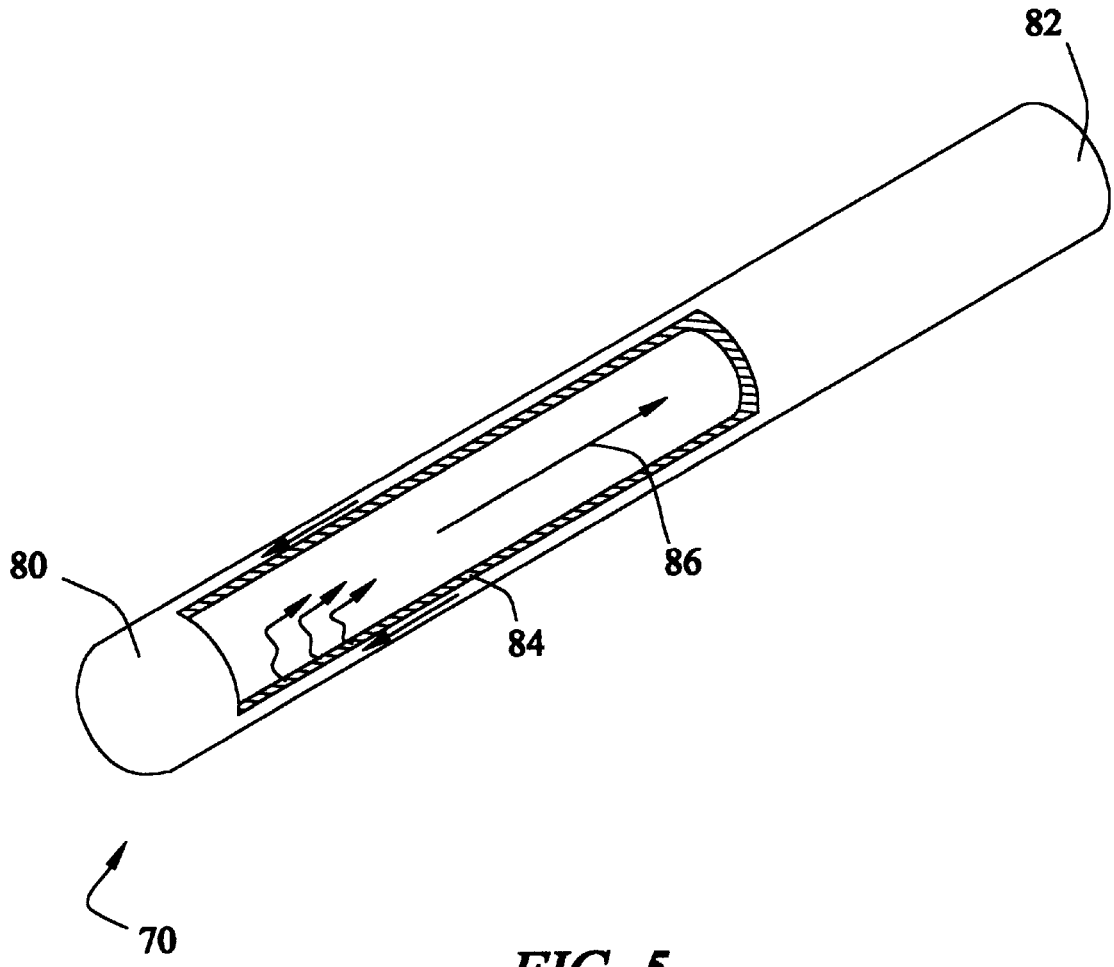
FIG. 5 is a perspective with partial cross-section of a heat pipe included in the cathode assembly of the x-ray tube of FIG. 1.

Heat pipe 70 is preferably an evacuated, sealed metal pipe partially filled with a working fluid. As shown in FIG. 5, the internal walls of heat pipe 70 contain a capillary wick structure 84 extending from an evaporator end 80 to a condenser end 82. Capillary wick structure 84 allows heat pipe 70 to operate against gravity by transferring the liquid form of the working fluid to the opposite end of heat pipe 70 where it is vaporized by heat. In general, heat pipe 70 channels or selectively directs heat away from a source of heat such as cathode cup 50.

Figure 6:
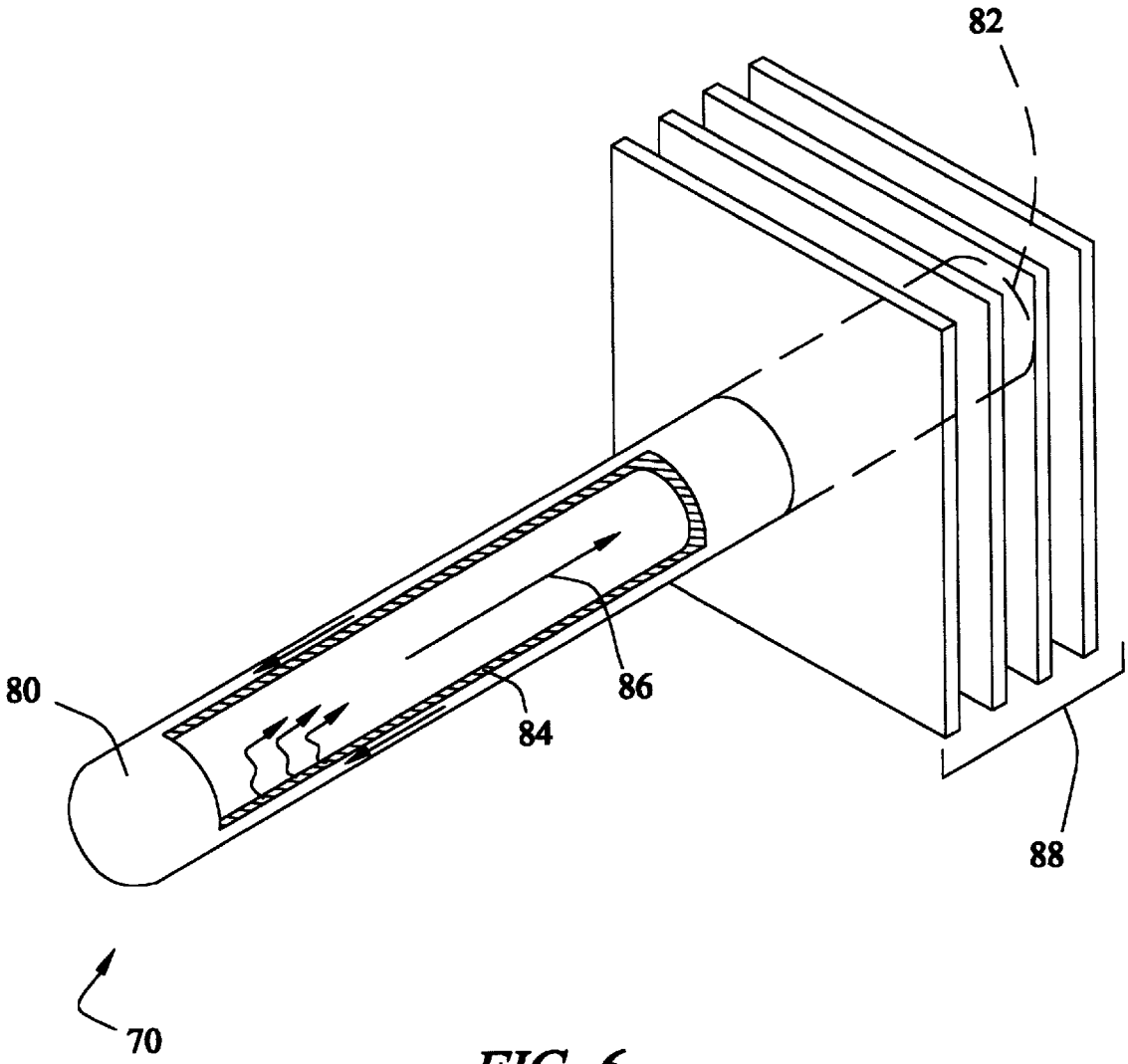
FIG. 6 is a perspective view with partial cross-section of a second heat pipe included in the cathode assembly of the x-ray tube of FIG. 1.

Heat pipes (as shown in FIGS. 5 & 6) have found wide application in space-based applications, electronic cooling, and other high-heat-flux applications. For example, heat pipes can be found in satellites, laptop computers, and generators. A wide variety of working fluids have been used with heat pipes, including, nitrogen, ammonia, alcohol, water, sodium, lithium, and other suitable fluids. Heat pipes have the ability to dissipate very high heat fluxes and heat loads through small cross sectional areas. Heat pipes have a very large effective thermal conductivity and can move a large amount of heat from source to sink. A typical heat pipe can have an effective thermal conductivity more than two orders of magnitude larger than a similar solid copper conductor. Advantageously, heat pipes are totally passive and are used to transfer heat from a heat source to a heat sink with minimal temperature gradients, or to isothermalized surfaces.

In the exemplary embodiment, heat pipe 70 is made of copper and includes water as a working fluid. Alternatively, heat pipe 70 is made of monel or some other material. Heat pipes can be manufactured using a wide range of materials and working fluids spanning the temperature range from cryogenic to molten lithium. Heat pipes suitable for this application are commercially available.

In operation, heat from cathode cup 50 enters evaporator end 80 of heat pipe 70 where the working fluid is evaporated, creating a pressure gradient in the pipe. The pressure gradient forces the resulting vapor through the hollow core of heat pipe 70 to the cooler condenser end 82 where the vapor condenses and releases its latent heat of vaporization to the heat sink. The liquid is then wicked back by capillary forces through capillary wick structure 84 to evaporator end 80 in a continuous cycle. For a well designed heat pipe, effective thermal conductivities can range from 10 to 10,000 times the effective thermal conductivity of copper depending on the length of the heat pipe.

Heat pipe 70 greatly increases the heat flow from the source of the heat in the filaments back to the cooler oil that is in x-ray tube casing 22. Referring now to FIG. 3, heat pipe 70 is coupled to post 54 at one end. The other end of heat pipe 70 is brazed to a braze plate at ceramic insulator 56. The heat is then transferred from the top of post 54 to ceramic insulator 56 and ultimately is dissipated into the oil contained in vessel 44 and surrounding cathode assembly 42 by convection.

Figure 4:
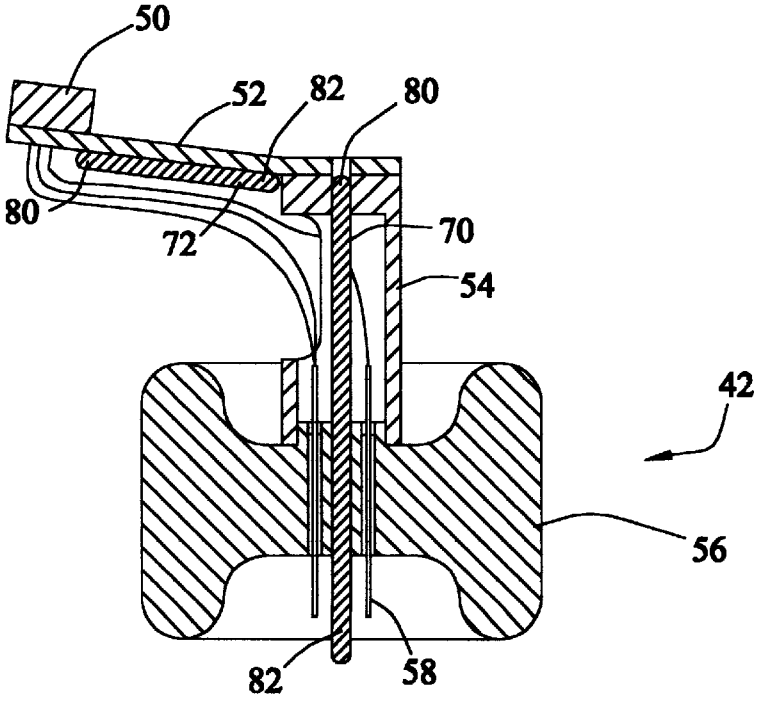
FIG. 4 is a cross sectional view of the cathode assembly of a second embodiment of the x-ray tube of FIG. 1.

FIG. 4 illustrates a cross sectional view of a second embodiment of cathode assembly 42, including a second heat pipe 72 brazed in arm 52. Heat pipe 72 increases the transfer of heat away from cathode cup 50 toward the top of post 54. In this embodiment, heat pipe 70 passes through cathode insulator 56 and is welded to a weld prep on cathode insulator 56 to make a vacuum seal. As such, heat pipe 70 is in direct contact with the cooling oil contained within vessel 44. Advantageously, heat pipe 70 can also serve simultaneously as one of the electrical paths for the cathode (not shown), in which case heat pipe 70 would take the place of one of the electrical connectors 58. In the embodiment of cathode assembly 42 shown in FIG. 4, heat pipe 70 can include fin structures 88 at condenser end 82 (FIG. 6). Fin structures 88 enhance convective heat transfer to the oil in order to assist in further cooling condenser end 82.

The benefits of cathode assembly 42 with heat pipe 70 (and possibly heat pipe 72) include that cathode cup 50 runs significantly cooler. Cooler temperatures permit higher performance of the x-ray tube 12 without causing braze joint failures and cathode bolted joint failures. Cathode assembly 42 includes a greater ability to produce long duration scans and greater patient throughput, without sacrificing image quality or long term reliability of the x-ray tube due to joint failure or mechanical component distortions. In addition, thermal and plastic deformations of arm 52 are eliminated. Further, by removing the joint failures and component distortions, the image quality of the x-ray tube will not be compromised due to thermal issues with the cathode. The light weight of heat pipe 72 will also make it possible to obtain the greater heat transfer from the cathode cup without decreasing the natural frequency of the cathode assembly. Low natural frequencies of the cathode assembly are known to cause image quality problems due the wobbling of the focal spot in the x-ray tube.

While the embodiments illustrated in the FIGURES and described above are presently preferred, it should be understood that these embodiments are offered by way of example only. Other embodiments may include heat pipes in other locations of cathode assembly 42. The invention is not limited to a particular embodiment, but extends to various modifications, combinations, and permutations that nevertheless fall within the scope and spirit of the appended claims.

What is claimed is:

1. An x-ray tube for emitting x-rays which includes an anode and a cathode, the x-ray tube comprising:

a housing;

an anode disposed in the housing and including a target;

a cathode disposed in the housing at a distance from the anode, the cathode includes an electron emitter configured to emit electrons which hit the target of the anode and produce x-rays; and a heat pipe thermally coupled to the cathode and extending away from the electron emitter, the heat pipe providing transfer of thermal energy away from the electron emitter.

2. The x-ray tube of claim 1, wherein the heat pipe comprises an evacuated sealed metal pipe partially filled with a fluid.

3. The x-ray tube of claim 2, wherein the heat pipe includes internal walls having a capillary wick structure, the capillary wick structure providing for the transfer of fluid from one end of the heat pipe to another end irregardless of gravity.

4. The x-ray tube of claim 2, wherein the fluid partially filling the evacuated sealed metal pipe comprises water.

5. The x-ray tube of claim 1, wherein the heat pipe comprises a fin structure at an end of the heat pipe distal to the electron emitter.

6. The x-ray tube of claim 1, wherein the target rotates.

7. The x-ray tube of claim 1, wherein the cathode further comprises a cathode cup containing electron emitting filaments and a cathode insulator coupled to the cathode cup by a connecting structure.

8. The x-ray tube of claim 7, wherein the heat pipe includes an evaporator end and a condenser end, the evaporator end located on one end of the connecting structure and the condenser end located at the cathode insulator.

9. The x-ray tube of claim 7, wherein the connecting structure includes an arm and a post, the arm extending from the cathode cup to the post, the post extending to the cathode insulator.

10. The x-ray tube of claim 9, wherein the heat pipe extends from the post to the cathode insulator.

11. The x-ray tube of claim 9, further comprising a second heat pipe extending from the cathode cup to the post along the arm.

12. An x-ray tube for emitting x-rays with increased performance by effective heat dissipation, the x-ray tube comprising:

an electron source, the electron source emitting electrons;

an x-ray source, the x-ray source providing x-rays from a bombardment of electrons from the electron source; and heat pipe means for selectively directing heat energy away from the electron source.

13. The x-ray tube of claim 12, wherein the heat pipe means for selectively directing heat energy away from the electron source transfers thermal energy away from the electron source independent of gravitational forces.

14. The x-ray tube of claim 12, wherein the heat pipe means for selectively directing heat energy away from the electron source also provides an electrical path for the electron source.

15. The x-ray tube of claim 12, wherein the target rotates.

16. A method for dissipating heat from a cathode in an x-ray tube during operation of the x-ray tube, the method comprising:

providing electrons using an electron emitter in the cathode, the electrons producing x-rays and heat upon impact with a target; and transferring heat away from the electron emitter with at least one heat pipe.

17. The method of claim 16, wherein the at least one heat pipe comprises an evacuated sealed metal pipe partially filled with fluid and the transferring heat away from the electron emitter step further comprises vaporizing the fluid at an evaporator end of the at least one heat pipe and liquefying the vaporized fluid at a condenser end of the at least one heat pipe.

18. The method of claim 17, wherein the fluid is water.

19. The method of claim 16, wherein the at least one heat pipe extends any one of through an insulator and not through the insulator.

20. The method of claim 16 further comprising providing an electrical path for the cathode.

* * * * *